US008499579B2

(12) United States Patent
Luisi et al.

(10) Patent No.: US 8,499,579 B2
(45) Date of Patent: Aug. 6, 2013

(54) BUILT-IN REFRIGERATOR PROVIDED WITH A WATER AND DRINKS DISPENSER

(75) Inventors: Armando Luisi, Comerio (IT); Fiorenzo Casoli, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 956 days.

(21) Appl. No.: 12/521,864

(22) PCT Filed: Dec. 20, 2007

(86) PCT No.: PCT/EP2007/064349

§ 371 (c)(1), (2), (4) Date: Jun. 30, 2009

(87) PCT Pub. No.: WO2008/080882

PCT Pub. Date: Jul. 10, 2008

(65) Prior Publication Data

US 2010/0066226 A1 Mar. 18, 2010

(30) Foreign Application Priority Data

Jan. 4, 2007 (IT) ..... VA2007A0001

(51) Int. Cl.
*F25D 3/00* (2006.01)

(52) U.S. Cl.
USPC ..... 62/389; 62/261; 312/405

(58) Field of Classification Search
USPC ..... 62/265, 389, 261, 266, 391; 49/501; 312/204, 401, 405, 109
See application file for complete search history.

(56) References Cited

U.S. PATENT DOCUMENTS 5,020,189 A * 6/1991 Grome et al. ..... 16/286
2005/0160746 A1 7/2005 Kwon

FOREIGN PATENT DOCUMENTS

DE 2347963 A1 4/1975
GB 2246195 A * 1/1992
JP 6117750 A 4/1994

* cited by examiner

*Primary Examiner* — Frantz Jules
*Assistant Examiner* — Cassey D Bauer
(74) *Attorney, Agent, or Firm* — Kirk W. Goodwin; Daniel M. Blakeslee

(57) ABSTRACT

A built-in refrigerator includes a water and drinks dispenser, or an ice maker, placed on the outside of the refrigerator door. The refrigerator is installed in a modular kitchen furniture unit provided with a door panel. A sliding connection between the dispenser and the door panel of the furniture unit allows the simultaneous opening and closing of the door and the door panel and, when the door is in the closed position, prevents residual liquids or solids from falling into the air space existing between the door and the door panel.

6 Claims, 2 Drawing Sheets

BUILT-IN REFRIGERATOR PROVIDED WITH A WATER AND DRINKS DISPENSER

CROSS-REFERENCE TO RELATED APPLICATIONS

This application claims priority on International Application No. PCT/EP2007/064349, filed Dec. 20, 2007, which claims priority on Italian Application No. VA2007/A/000001, filed Jan. 4, 2007, both of which are incorporated by reference.

The subject-matter of the present invention is a built-in refrigerator equipped with accessory devices, such as a water dispenser or an ice-making machine, that can be used from outside the refrigerator when it is fitted in a furniture unit.

There are known free-standing refrigerators provided with water dispensers, ice-makers or also coffee machines incorporated into the structure of the refrigerator door.

GB 246195 also discloses a built-in refrigerator, on the door of which is applied a decorative covering panel having an opening corresponding to the portion of the door where the accessory is located, in just the same way as is done with said free-standing refrigerators. Such a panel is fixed to the outer side of the refrigerator door, so as to be continuous with the door itself.

Using the constructions known heretofore it is not, however, possible to install a built-in refrigerator inside a standard furniture unit of a modular kitchen that can be closed by means of a door panel hinged to the cabinet of the furniture unit, since for these types of installation the refrigerator door has to be fixed to the door panel by means of a sliding mechanism, for example with a skid, in order to allow the simultaneous opening and closing of the door and the door panel. In these latter types of installation, when the door and the door panel are closed, they are arranged parallel to each other, with an empty space in the middle. And it is precisely the presence of this empty space that hinders the application of said accessories on the door of a built-in refrigerator. In fact, residues from the water or coffee dispenser and/or fragments of ice can fall into such a space or fissure separating the accessory from the door panel, making it problematic to drain residual liquids and solids, consequently creating a potentially favourable atmosphere for the growth of bacteria or mildew or one that would require very frequent cleaning.

The aim of the present invention is to provide a solution to the above-mentioned problems. This aim is achieved thanks to the characteristics listed in the attached claims.

Figure 1:
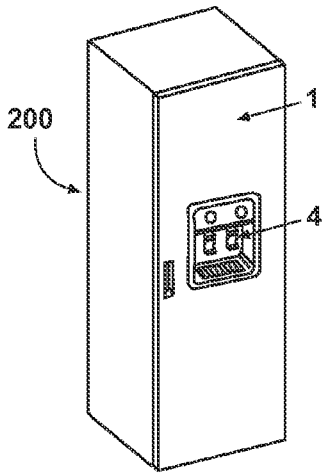
Figure 2:
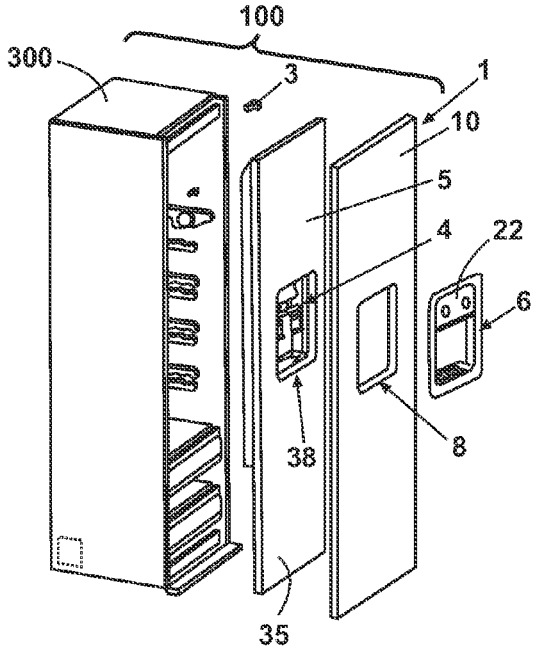
Figure 3:
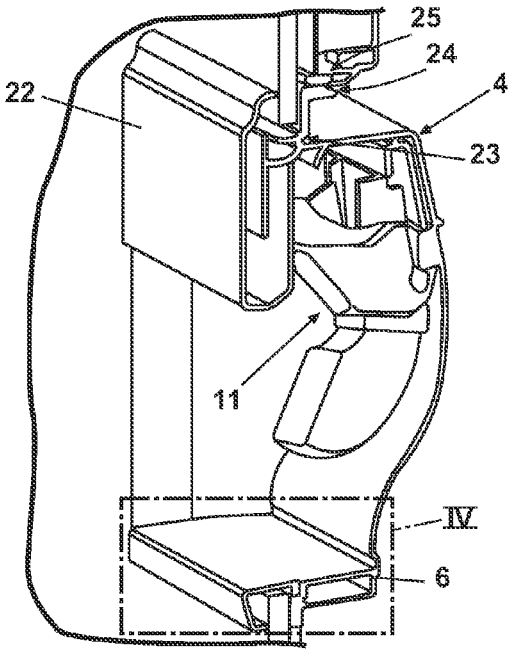
Figure 4:
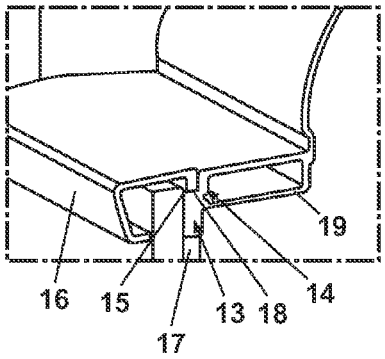

Further advantages and characteristics of the present invention will be apparent from the following detailed description provided by way of non-restrictive example, with reference to the attached drawings in which:

FIG. 1 is a perspective view of a built-in refrigerator according to the invention, installed in a furniture unit, FIG. 2 shows the exploded detail of the refrigerator in FIG. 1, FIG. 3 shows two sections of the detail of the construction of the housing compartment for the refrigerator accessories according to the invention, connected to the frame by means of a sliding connection, FIG. 4 shows an enlarged detail of a portion of FIG. 3.

Figure 5:
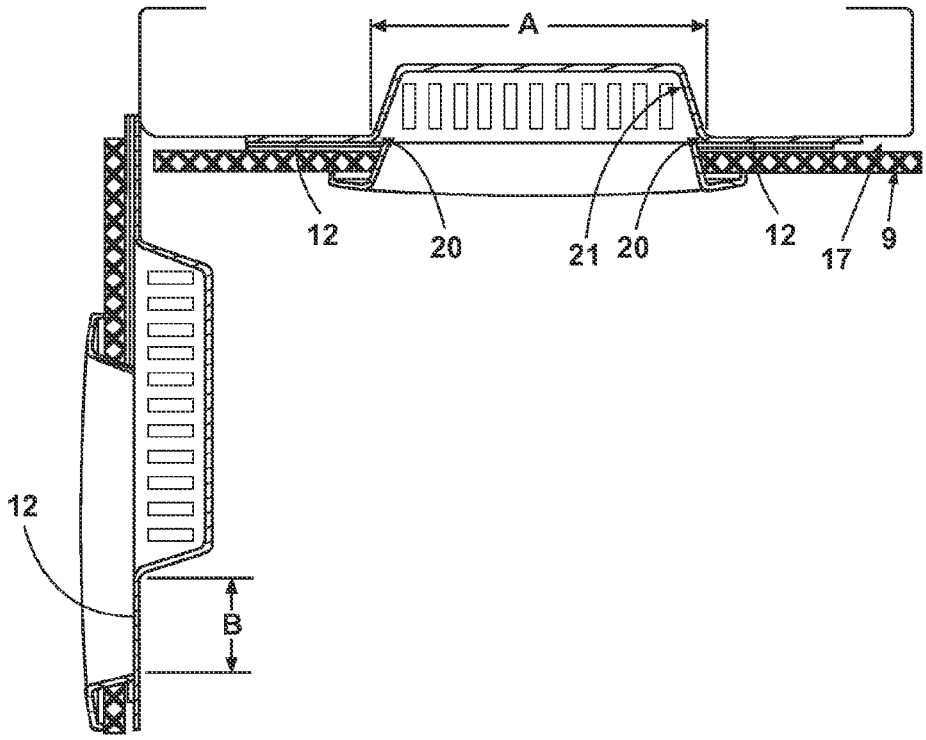

FIG. 5 shows a detail of the section of the refrigerator according to the invention, in which the door of the refrigerator and the connected door panel are illustrated in the two positions: fully open and fully closed.

With reference to FIGS. 1 and 2, a built-in refrigerator 100 is installed inside the cabinet of a furniture unit 200, usually made of wood, provided with a door panel 1 hinged to said furniture unit. The door 2 of the refrigerator hinged to the structure of the refrigerator 300 is connected to the door panel 1 of the furniture unit 200 by means of a usual skid-type device (not illustrated), which allows the door 2 of the refrigerator 100 to slide inside the door panel 1 hinged to the furniture unit 200, remaining parallel it to it throughout the opening and closing movement, thanks also to different, independent axes of rotation established by the hinges of the door 3 and the door panel (not illustrated). With this system for connecting the door 2 and the door panel 1, the action of the user is like opening or closing a single door, instead of opening or closing the two doors in sequence.

Inside the door 2 of the refrigerator 100, an outer compartment 4 made of plastic is produced, inside which a water dispenser 11 is fully housed, integrally fixed to the door 2 of the refrigerator.

According to the present invention, as an alternative to the water dispenser, other accessories can be housed in the compartment, such as an ice-maker, coffee machine, a sparkling water mixer, a steam generator, a steriliser or a combination of these.

In the door panel 1 a window 8 is produced corresponding to said compartment 4, which allows the user to access the dispenser 11 fully enclosed in the compartment 4. Normally the user uses the water dispenser 11 when the door 2 and the door panel 1 of the refrigerator are in the closed position.

With reference to FIG. 3, a frame 6, made of plastic, is applied to the outer side 10 of the door panel 1 surrounding the opening 8, covering the perimeter, so as to eliminate sharp edges. Said frame 6 incorporates a portion of the control interface 22 of the dispenser 11, but could incorporate the entire control for the operation of said dispenser 11.

This frame 8 could be made from various materials and could be composed of one or more components. In a preferred embodiment the frame 6 is made of a single piece of plastic material.

The power supply and signals to the user interface 22 come from the furniture unit 300 of the refrigerator 100 by means of a flexible lead 23 that runs between the door panel 1 and the compartment 4 and that reaches the door of refrigerator 2 with a plug 24. The base 25 for connecting the plug 24 of the lead 23 is incorporated into the portion adjacent to the compartment 4. Alternative connection solutions, for example wireless connectors, can however be used.

A portion 15 of the frame 6 is moulded like a track and is at least as long as the width A of the compartment 4. This portion 15 is located in the lower part of the frame 6 [and] faces into the space between the door and the door panel, constituting a first sliding connection means, suitable for being connected to a corresponding second connection means, for example a channel, which has to be fixed to the refrigerator door. Said portion 15 could be placed as an alternative or in addition in a portion above said compartment 4, On the other hand, in the door of the refrigerator 2, the compartment 4 is placed between two decorative side panels 12 placed on the outer surface 5 of the refrigerator door 2, which extend from the compartment 4 towards the outer sides of the door 2 of the refrigerator 100, as shown in FIG. 4. Said decorative panels 12, being integral with the door 2 of the refrigerator 100, slide in the act of opening and closing the door 2 of the refrigerator 100 connected with the door panel 1 of the furniture unit 200 when the refrigerator 100 is installed in the furniture unit 200 facing, partly along a length B or fully, corresponding to the window 8 in the door panel 1. In relation to the type of assembly of the door 2 and the door panel 2 [sic], whether hinged on the right or left, only one of the two side decorative panels 12 is arranged corresponding to the window 8 in the act of opening, as illustrated in FIG. 4.

Moreover, as shown in FIG. 3, the compartment 4 has on the lower side 30 an edge 13, protruding by a few millimetres from the flat surface 35 of the door 2 of the refrigerator 100, which has a guide 14 or channel, capable of constituting the corresponding second sliding connection means fixed integral with the refrigerator door 2, which can be connected to the first connection means. Inserting the track 15 into the channel 14 during the installation of the refrigerator 100, the two connection means are connected, allowing the track 15 to slide inside the channel 14 during the opening and the closing of the door 2 and the door panel 1, During this movement the compartment 4 of the refrigerator 100 slides substantially parallel with respect to the door panel 1. As illustrated in FIG. 4, in a closed position, the compartment 4 and the window 8 are aligned and continuity between the compartment 4 and the frame 6 is ensured, preventing residual liquids and solids from leaking into the space or fissure 17.

In a preferred embodiment the channel 14 is equipped with a hole 18 for the drainage of any water that might have trickled in during dispensing, and which pours it back into the small basin 19, placed below the dispenser 11.

In complementary manner, equivalent to what has been described heretofore, the first and second sliding connection means could be constituted the other way round by a channel and a track respectively. Other forms of sliding connection between the door panel 1 and the compartment 4, equivalent to those previously described, are applicable.

Finally, on the door of the refrigerator 2, on the sides of the compartment 4, two vertical ribs 20 are arranged as a continuation of the wall 21 of the compartment 4, capable of closing off most of the space 17 between the compartment 4 [and] the door panel of the furniture unit 20, delimiting the surface around the compartment 4 of the housing of the dispenser when the refrigerator door is closed.

Finally, it is stated that in a particular embodiment of the present invention, the sliding connection means 14, 15 replace the traditional connection means between the door 2 of the refrigerator 100 and the door panel 1 of the furniture unit 300, since they can incorporate the functions thereof.

As described above, a built-in refrigerator equipped with accessory devices has been produced, accessible from the outside of the refrigerator when this is installed in the furniture unit, in which continuity is ensured between the accessory and the door panel. In the closed position of the door, when the accessories are used, liquid residues from the water and coffee dispenser and/or solid residues, for example ice fragments, are prevented from falling into such a fissure.

The invention claimed is:

1. A combination comprising:

a furniture unit defining an interior and a door panel, with a frame in an opening, hingedly mounted to the furniture unit to provide selective access to the interior; and a built-in refrigerator inserted into the furniture unit and comprising:

a door in which is formed an outer compartment, wherein the outer compartment and the opening are aligned in a closed position of the door of the refrigerator;

an accessory received within the outer compartment; and a slidable connection between the door panel and the door such that the door is slidably connected to the door panel at least by the frame being slidably connected at a peripheral area of the compartment when the door is slidably connected to the door panel;

wherein the slidable connection comprises a first sliding connection comprising one of a channel and track carried by one of the door or door panel, and a second sliding connection comprising the other of the channel and track provided on the other of the door or door panel, wherein the channel is provided with a hole for the drainage of liquids.

2. The combination according to claim 1 wherein when in the closed position of the door, the frame ensures continuity between the compartment and the accessory to prevent the leakage of residual liquids and solids from the accessory.

3. The combination according to claim 1 wherein the first and second sliding connections are made of plastic material.

4. The combination according to claim 1, wherein the slideable connection allows the simultaneous opening and closing of the door panel and the door.

5. The combination according to claim 1 wherein a side of the compartment has vertical ribs arranged as a continuation of a wall of the compartment capable of closing off most of a space between the compartment and the door panel.

6. The combination according to claim 5 wherein the accessory comprises at least one of a drink dispenser, ice-maker, coffee machine, sparkling water mixer, hot water and vapour generator, and sterilizer.

* * * * *